US011779120B2

(12) United States Patent
Richardson

(10) Patent No.: US 11,779,120 B2
(45) Date of Patent: Oct. 10, 2023

(54) CHAIRS WITH ADJUSTABLE BACK SUPPORTS

(71) Applicant: LCL Enterprises, Inc., Mukilteo, WA (US)

(72) Inventor: Kevin Richardson, Everett, WA (US)

(73) Assignee: LCL ENTERPRISES, INC., Mukilteo, WA (US)

( * ) Notice: Subject to any disclaimer, the term of this patent is extended or adjusted under 35 U.S.C. 154(b) by 0 days.

(21) Appl. No.: 17/201,236

(22) Filed: Mar. 15, 2021

(65) Prior Publication Data

US 2021/0307518 A1 Oct. 7, 2021

Related U.S. Application Data

(63) Continuation of application No. 16/274,059, filed on Feb. 12, 2019, now Pat. No. 10,973,332.

(60) Provisional application No. 62/630,188, filed on Feb. 13, 2018.

(51) Int. Cl.

| | |
|---|---|
| ***A47C 1/024*** | (2006.01) |
| ***A47C 7/46*** | (2006.01) |
| ***A47C 7/44*** | (2006.01) |
| ***A47C 1/023*** | (2006.01) |

(52) U.S. Cl.

CPC ..... *A47C 7/46* (2013.01); *A47C 1/023* (2013.01); *A47C 7/448* (2013.01)

(58) Field of Classification Search

CPC ..... A47C 1/023; A47C 7/40

See application file for complete search history.

(56) References Cited

U.S. PATENT DOCUMENTS

| | | | |
|---|---|---|---|
| 717,026 | A | 12/1902 | Ostendorf |
| 1,420,924 | A | 6/1922 | Hogan |
| 1,699,894 | A | 1/1929 | Klemm |
| 1,867,600 | A | 7/1932 | Schwarzkopf |
| 1,941,340 | A | 12/1933 | Louis |

(Continued)

FOREIGN PATENT DOCUMENTS

| | | | |
|---|---|---|---|
| CN | 2151738 | Y | 1/1994 |
| CN | 201119969 | Y | 9/2008 |

(Continued)

OTHER PUBLICATIONS

International Search Report of PCT/CN2008/001636 dated Nov. 27, 2008, 6 pages.

U.S. Appl. No. 62/630,188 for Richardson, filed Feb. 13, 2018.

*Primary Examiner* — Shin H Kim

(74) *Attorney, Agent, or Firm* — Perkins Coie LLP

(57) ABSTRACT

An adjustable chair can support an occupant that sits on a front portion of a seat cushion. When the user leans back, the chair can provide back support without requiring that the user slide rearwardly along the seat cushion, thereby providing back support to minimize, limit, or substantially eliminate lower back fatigue, discomfort, or the like. A back support of the chair can be located at a desired forward/rearward position based on the user's position on the seat. In some settings, the chair can be used by a card dealer who tends to sit on a forward portion of the seat when dealing cards. The back support can be positioned to comfortably support the dealer's back when, for example, the dealer sits generally upright. The chair can also be used by other individuals that frequently sit on the front of the seat cushion.

15 Claims, 4 Drawing Sheets

(56) References Cited

U.S. PATENT DOCUMENTS

| | | | |
|---|---|---|---|
| 2,364,050 | A | 12/1944 | Benson |
| 2,687,765 | A | 8/1954 | Constance |
| 2,919,746 | A | 1/1960 | Nellie |
| 3,145,053 | A | 8/1964 | Thompson et al. |
| 3,188,136 | A | 6/1965 | Redfield et al. |
| 3,220,771 | A | 11/1965 | Doss |
| 3,227,440 | A | 1/1966 | Scott |
| 3,319,747 | A | 5/1967 | Lauper |
| 3,511,533 | A | 5/1970 | Drabert |
| 3,649,074 | A | 3/1972 | Mcdonald et al. |
| 3,810,673 | A | 5/1974 | Shoji |
| 3,897,102 | A | 7/1975 | Lemaire |
| 4,102,549 | A | 7/1978 | Morrison et al. |
| 4,159,145 | A | 6/1979 | Quakenbush |
| 4,170,800 | A | 10/1979 | Wiberg |
| 4,285,541 | A | 8/1981 | Onishi |
| 4,387,888 | A | 6/1983 | Marinakis |
| 4,516,805 | A | 5/1985 | Leeper et al. |
| 4,650,249 | A | 3/1987 | Serber |
| 4,660,549 | A | 4/1987 | Kowalski et al. |
| 4,795,214 | A | 1/1989 | Holdt |
| 4,805,928 | A | 2/1989 | Nakao et al. |
| 4,832,407 | A | 5/1989 | Serber |
| 5,035,466 | A | 7/1991 | Mathews et al. |
| 5,060,327 | A | 10/1991 | Celestina et al. |
| 5,086,769 | A | 2/1992 | Vianello et al. |
| 5,098,158 | A | 3/1992 | Palarski |
| 5,209,509 | A | 5/1993 | Gay et al. |
| 5,232,426 | A | 8/1993 | Van |
| 5,261,723 | A | 11/1993 | Hosoe |
| 5,315,722 | A | 5/1994 | Djie |
| 5,350,346 | A | 9/1994 | Martinez |
| D352,635 | S | 11/1994 | Yoder |
| 5,401,078 | A | 3/1995 | Riach |
| 5,487,590 | A | 1/1996 | Haynes |
| 5,538,011 | A | 7/1996 | Craft et al. |
| 5,575,534 | A | 11/1996 | Yu |
| 5,599,066 | A | 2/1997 | Chih |
| 5,642,542 | A | 7/1997 | Kometani |
| 5,645,313 | A | 7/1997 | Best et al. |
| 5,653,499 | A | 8/1997 | Goodall |
| 5,678,894 | A | 10/1997 | Eley |
| 5,762,402 | A | 6/1998 | Gillotti |
| 5,839,784 | A | 11/1998 | Breen |
| 5,875,779 | A | 3/1999 | Fuhrman et al. |
| 5,887,946 | A | 3/1999 | Raftery |
| 5,902,013 | A | 5/1999 | Hong |
| 5,926,871 | A | 7/1999 | Howard |
| 5,967,610 | A | 10/1999 | Lin |
| 5,971,475 | A | 10/1999 | Lawson et al. |
| 5,971,485 | A | 10/1999 | Clark |
| 6,010,192 | A | 1/2000 | King |
| 6,012,184 | A | 1/2000 | Childers |
| 6,086,157 | A | 7/2000 | Toso |
| 6,089,593 | A | 7/2000 | Hanson et al. |
| 6,135,548 | A | 10/2000 | Mcguire |
| 6,212,713 | B1 | 4/2001 | Kuck et al. |
| 6,296,313 | B1 | 10/2001 | Wu |
| 6,315,319 | B1 | 11/2001 | Hanson et al. |
| 6,354,664 | B1 | 3/2002 | Chen |
| 6,394,547 | B1 | 5/2002 | Vik |
| 6,446,287 | B2 | 9/2002 | Borders et al. |
| 6,467,848 | B1 | 10/2002 | Gien et al. |
| 6,543,853 | B1 | 4/2003 | Splane |
| 6,619,747 | B2 | 9/2003 | Ko et al. |
| 6,634,711 | B2 | 10/2003 | Phillips et al. |
| 6,659,560 | B1 | 12/2003 | Chi |
| 6,698,431 | B1 | 3/2004 | Harris et al. |
| 6,767,066 | B1 | 7/2004 | Tornero |
| 6,805,409 | B2 | 10/2004 | Parker |
| 6,824,219 | B2 | 11/2004 | Rueckstaedter |
| 6,846,042 | B2 | 1/2005 | Hanson et al. |
| 6,854,807 | B2 | 2/2005 | D'Alessandro |
| 6,918,143 | B2 | 7/2005 | Wiberg |
| 6,994,400 | B2 | 2/2006 | Koepke et al. |
| 7,021,037 | B1 | 4/2006 | Szymas |
| 7,080,885 | B2 | 7/2006 | Bain et al. |
| 7,147,282 | B2 | 12/2006 | Hatcher et al. |
| 7,159,942 | B2 | 1/2007 | Costaglia |
| 7,172,250 | B2 | 2/2007 | Wu |
| 7,222,920 | B1 | 5/2007 | Washington |
| 7,234,768 | B2 | 6/2007 | Manning |
| 7,234,775 | B2 | 6/2007 | Serber |
| 7,293,834 | B2 | 11/2007 | Riach et al. |
| 7,357,456 | B1 | 4/2008 | Freer et al. |
| 7,401,858 | B2 | 7/2008 | Lee |
| 7,431,396 | B1 | 10/2008 | Dasso |
| 7,600,817 | B2 | 10/2009 | Kramer et al. |
| 7,618,090 | B2 | 11/2009 | Grenon |
| 7,770,976 | B2 | 8/2010 | Lee |
| 7,784,871 | B2 | 8/2010 | Cochran |
| 7,963,592 | B1 | 6/2011 | Stanley |
| 8,104,838 | B2 | 1/2012 | Tsai |
| 8,272,692 | B1 | 9/2012 | Epperson |
| 8,602,496 | B2 | 12/2013 | Lu |
| 8,651,569 | B2 | 2/2014 | Andoloro et al. |
| 9,084,486 | B1 | 7/2015 | Richardson et al. |
| 9,131,775 | B1 | 9/2015 | Eisenberg |
| 9,320,359 | B2 * | 4/2016 | Lu ..... A47C 1/023 |
| 9,375,088 | B2 | 6/2016 | Andoloro |
| 9,398,993 | B2 | 7/2016 | Wei et al. |
| 9,451,831 | B2 | 9/2016 | Richardson et al. |
| 9,498,398 | B1 | 11/2016 | Ehrenleitner |
| 9,578,971 | B2 * | 2/2017 | Su ..... A47C 1/0307 |
| 9,853,438 | B2 | 12/2017 | Chae et al. |
| 10,238,213 | B2 | 3/2019 | Richardson et al. |
| 10,383,444 | B1 | 8/2019 | Parkins |
| 10,506,881 | B2 | 12/2019 | Richardson et al. |
| 10,973,332 | B2 | 4/2021 | Richardson |
| 2002/0000008 | A1 | 1/2002 | Borders |
| 2002/0067060 | A1 | 6/2002 | Lloyd |
| 2002/0158492 | A1 | 10/2002 | Ko et al. |
| 2003/0011221 | A1 | 1/2003 | Yoshie et al. |
| 2004/0133979 | A1 | 7/2004 | Newkirk et al. |
| 2006/0103221 | A1 | 5/2006 | Kleist |
| 2006/0225212 | A1 | 10/2006 | Parson et al. |
| 2007/0035164 | A1 | 2/2007 | North |
| 2007/0052275 | A1 | 3/2007 | Ghilzai |
| 2007/0069564 | A1 | 3/2007 | Lee |
| 2007/0108805 | A1 | 5/2007 | Manning |
| 2007/0126202 | A1 | 6/2007 | Crosby |
| 2008/0084101 | A1 | 4/2008 | Powicki et al. |
| 2009/0250565 | A1 | 10/2009 | Jaggers et al. |
| 2009/0295213 | A1 | 12/2009 | White |
| 2010/0001567 | A1 | 1/2010 | Powicki et al. |
| 2010/0237674 | A1 | 9/2010 | Lee |
| 2010/0295357 | A1 | 11/2010 | Koehler et al. |
| 2011/0272976 | A1 | 11/2011 | Wei et al. |
| 2015/0196122 | A1 | 7/2015 | Lu |
| 2017/0027328 | A1 | 2/2017 | Su |
| 2019/0208915 | A1 | 7/2019 | Donati |
| 2019/0223598 | A1 | 7/2019 | Jones |
| 2019/0313801 | A1 | 10/2019 | Powicki |

FOREIGN PATENT DOCUMENTS

| | | | |
|---|---|---|---|
| WO | 2009056004 | A1 | 5/2009 |
| WO | 2011087232 | A2 | 7/2011 |
| WO | 2013078569 | A1 | 6/2013 |

* cited by examiner

CHAIRS WITH ADJUSTABLE BACK SUPPORTS

CROSS-REFERENCE TO RELATED APPLICATIONS

This application is a continuation of U.S. patent application Ser. No. 16/274,059, filed Feb. 12, 2019, which claims the benefit of U.S. Provisional Application No. 62/630,188, filed Feb. 13, 2018, both of which are incorporated by reference herein in their entireties.

TECHNICAL FIELD

The present technology is related to chairs and associated methods of using the same. In particular, the present technology is related to chairs with adjustable back supports.

BACKGROUND

Conventional chairs are not designed to support an occupant's back when the occupant sits on a front portion of a seat cushion. When the occupant sits on the front portion of the seat cushion, the occupant's lower back may experience fatigue and discomfort because the chair's back support may be too far back to provide support. For example, card dealers at casinos often sit on the front edge of a seat cushion so that they can lean over a table to deal cards. Unfortunately, conventional chairs do not comfortably support the dealers back when, for example, the dealer sits upright. Sliding rearwardly along the seat cushion in order to contact the back support may be time-consuming and inconvenient. Accordingly, there is a need for chairs that comfortably support an occupant's back when the occupant tends to frequently lean forward and/or sit on the front section of a seat cushion.

SUMMARY

An exemplary embodiment is a chair that is reconfigurable for adjustable postural lumbar back support. The chair can be ergonomically designed to help support an user's back to, for example, reduce or limit fatigue (e.g. muscle fatigue in the user's lower back). In some embodiments, the chair has a back support that can be moved forwardly or rearwardly such that the back support supports the user's back when the user sits upright, including when the use sits on a front portion of the chair. In some embodiments, the back support can be translated between a rearward position and a forward position. In the rearward position, the back support can be positioned generally above or behind a cushioned seat of the chair. In the forward position, at least a portion or most of the back support can be positioned above the seat support. At some forward positions, the back support can support the user's upright back while the user sits on a front section of the seat support. In some configurations, the back support can be positioned to support an occupant's back when the occupant sits on the front half of the seat cushion. A front support surface of the back support can be positioned at a location generally midway along the seat cushion. An adjustment mechanism can be used to lock the back support at various positions. In one embodiment, the adjustment mechanism can bias the seat in a forward direction such that the back support moves forwardly against the user's back. This provides for quick adjustability.

In some embodiments, a chair can be configured to support an occupant that sits on only a portion of a seat cushion. When the user sits back, the back support can provide support without requiring that the user slide rearwardly along the seat cushion, thereby providing back support to minimize, limit, or substantially eliminate lower back fatigue, discomfort, or the like. The back support can be located at a desired forward/rearward position based on the user's position on the seat. In some settings, the chair can be used by a card dealer who tends to sit on a forward portion of the seat when dealing cards. The back support can be positioned to comfortably support the dealer's back when, for example, the dealer sits generally upright. The chair can also be used by other individuals that frequently sit on the front of the seat cushion.

In some embodiments, a chair includes a back support, a seat support assembly including a seat support and one or more wheels for rolling along a horizontal support surface, and a back support translating mechanism. The back support translating mechanism connects the back support to the seat support assembly. The back support translating mechanism is configured to translate the back support between a rearward position and a forward position. When the chair is supported on the horizontal support surface, the back support in the rearward position is positioned rearward of the seat support and the back support in the forward position is positioned directly above the seat support.

The back support translating mechanism can include a linear slide assembly coupled to the seat support assembly, a vertical support connecting the back support to the linear slide assembly, and a biasing device that biases the back support toward the forward position. The linear slide assembly can include a bracket coupled to the vertical support, and a plurality of linear extenders coupled to the bracket and the seat support assembly.

In further embodiments, a chair includes a back support, a seat support assembly including a seat support, and a slider mechanism. The slider mechanism has a locked configuration and an unlocked configuration. The slider mechanism in the unlocked configuration allows the back support to translate rearwardly and forwardly relative to the seat support. The slider mechanism in the located position prevent translation of the back support via the slider mechanism.

The slider mechanism can include a vertical support extending from the back support to the seat support assembly. The vertical support allows the back support to rotate relative to the seat support while the slider mechanism remains in the locked configuration. The slider mechanism can include a plurality of sliders coupled to the seat support assembly and a connector coupling the back support to the slider mechanism.

In some embodiments, a method of using a chair includes sitting at a forward position on a chair. The back support of the chair can move forwardly past a rearward portion of the seat assembly and to a forward position. The occupant can rest against the back support at the forward position.

In further embodiments, a method of adjusting a chair includes operating a release element of the chair to unlock an adjustment mechanism. After the adjustment mechanism has moved a back support to a forward position, the release element can be operated to unlock the adjustment mechanism, thereby allowing the back support to translate rearwardly relative to the seat support. The chair can be used when dealing one or more cards to players, performing a medical procedure, or the like.

DETAILED DESCRIPTION

Figure 1:
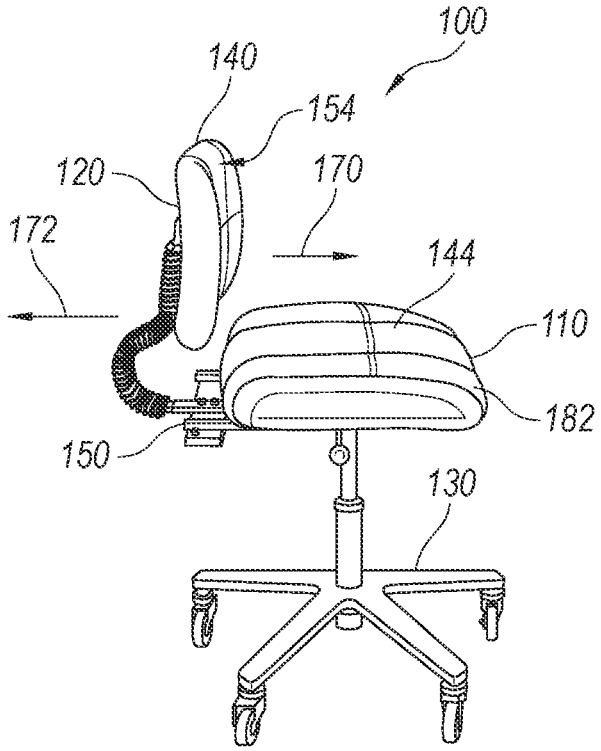
FIG. 1 is a side view of a chair with a back support in a rearward position in accordance with an embodiment of the present technology.
Figure 2:
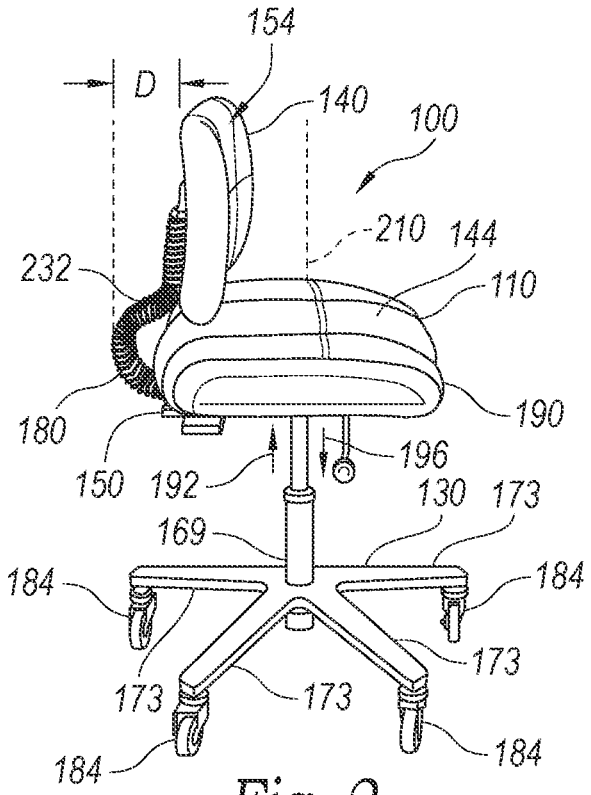
FIG. 2 is a side view of the chair with the back support in a forward position.

FIGS. 1 and 2 are side views of a chair 100 in accordance with an embodiment of present technology. Referring to FIG. 1, the chair 100 can include a seat support assembly 110, a back support assembly 120, and a base assembly 130. The seat support assembly 110 and the back support assembly 120 can be padded. The back support assembly 120 can include a back pad or support 140 ("back support 140") and an adjustment mechanism or translating mechanism 150 ("adjustment mechanism 150") for moving the back support 140.

FIG. 1 shows the back support 140 in a rearward position for supporting the back of an occupant sitting back on the seat support assembly 110. FIG. 2 shows the back support 140 in a forward position for supporting the occupant sitting at a forward portion of the seat support assembly 110. The adjustment mechanism 150 can be unlocked to translate the back support 140 back and forth, as indicated by arrows 170, 172 in FIG. 1. The back support assembly 120 can be repositioned at any time to minimize, limit, or substantially eliminate fatigue discomfort and/or pain. If the occupant sits at a forward position on the seat support assembly 110 for a significant length of time, the position of the back support assembly 120 can be selected as desired.

The adjustment mechanism 150 connects the back support 140 to the seat support assembly 110 and can translate the back support 140 between the rearward position (FIG. 1) and a forward position (FIG. 2). When the chair 100 is supported on a horizontal support surface, the back support 140 in the rearward position can be located rearward of the cushioned seat 144, and the back support 140 in the forward position can be positioned above the cushioned seat 144. The adjustment mechanism 150 can have one or more locking features and one or more handles, levels, or buttons that are used to operate (e.g., lock/unlock) the adjustment mechanism 150.

The adjustment mechanism 150 can automatically displace the back support 140. When the adjustment mechanism 150 is unlocked, one or more biasing devices can bias the back support 140 in a forward direction (e.g., a direction generally parallel to arrow 170 of FIG. 1). Referring to FIG. 2, the maximum distance of translation D can be equal to or greater than about 1 inch, about 2 inches, about 3 inches, about 4 inches, about 5 inches, about 6 inches, about 7 inches, about 8 inches, about 9 inches, about 10 inches, about 1 foot, or other suitable distances. In some embodiments, the distance D is selected based on the intended use of the chair and size of the seat 144. In some embodiments, the back support 140 can be moved across 10%, 20%, 30%, 40%, 50%, 60% of the length of the seat 144.

In some embodiments, a front surface 154 of the back support 140 of FIG. 1 can be positioned rearwardly of the entire seat support 144 about 1 inch, about 2 inches, about 3 inches, about 4 inches, about 5 inches, about 6 inches, about 7 inches, about 8 inches, about 9 inches, about 10 inches, about 1 foot, or other suitable distances. The front surface 154 of FIG. 2 can be positioned generally midway between the front and back of the seat 144. In other configurations, the front surface 154 can be positioned forwardly of the middle of the seat 144. In some embodiments, a vertical plane extending through the back support 140 can be positioned generally midway between ends 180, 190 of the seat 144, such that an occupant can sit on the front half of the seat support assembly 110 while the back support 140 supports the occupant's back.

When unoccupied, the back support 140 can be at an upright or substantially vertical orientation. As used herein, the term "substantially vertical" refers to ranges of small angles from vertical, for example, angles between about 0 degrees and 10 degrees from vertical, such as angles less than about 5 degrees, for example, angles less than about 2.5 degrees. When an occupant leans against the back support 140, the back support 140 can be fixed or movable (e.g., rotatable).

Referring to FIG. 2, the base assembly 130 can include a base member 169, arms 173, and wheels 184. The base member 169 can include a hydraulic assembly used to raise (indicated by arrow 192) and lower (indicated by arrow 196) the seat 144. The hydraulic assembly can include a bearing mount or pivot that allows rotation of the chair 100 about a vertical axis of rotation 210. A control element in the form of a lever can be used to lower the seat 144. The wheels 184 can be casters configured to roll along a support surface. The base assembly 130 can have other configurations that provide desired functionality.

Figure 3:
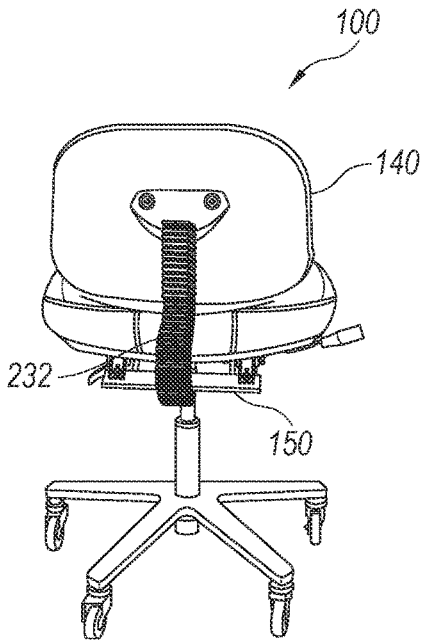
FIG. 3 is a back view of the chair in accordance with an embodiment of the present technology.
Figure 4:
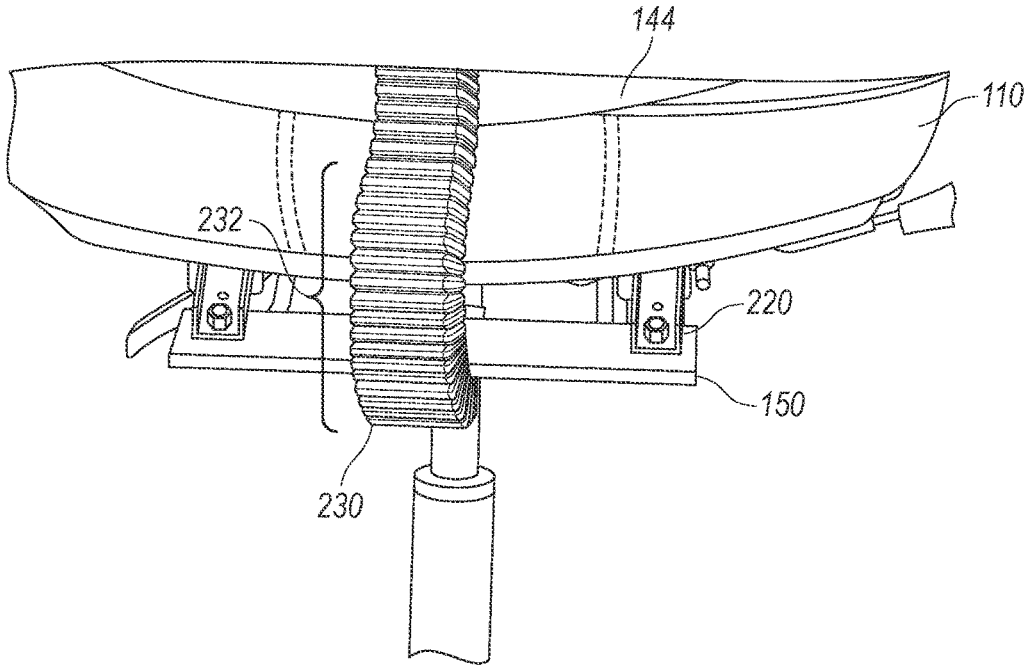
FIG. 4 is a detailed view of an adjustment mechanism in accordance with an embodiment of the technology.

FIG. 3 is a back view of the chair 100 in accordance with an embodiment of the technology. FIG. 4 is a detailed view of the adjustment mechanism 150. Referring now to FIG. 4, the adjustment mechanism 150 can include a slide assembly 220 connected to an elongated or vertical support 230 ("vertical support 230") that connects the seat 144 to the back support 140 (FIG. 3). In some embodiments, the back support 140 can include a plurality of vertical supports 230. Referring now to FIGS. 3 and 4, the vertical support 230 can have a curved region 232 configured to receive and extend about a rearward portion of the seat support assembly 110. This allows forward positioning of the back support 140, as shown in FIG. 2.

Figure 5:
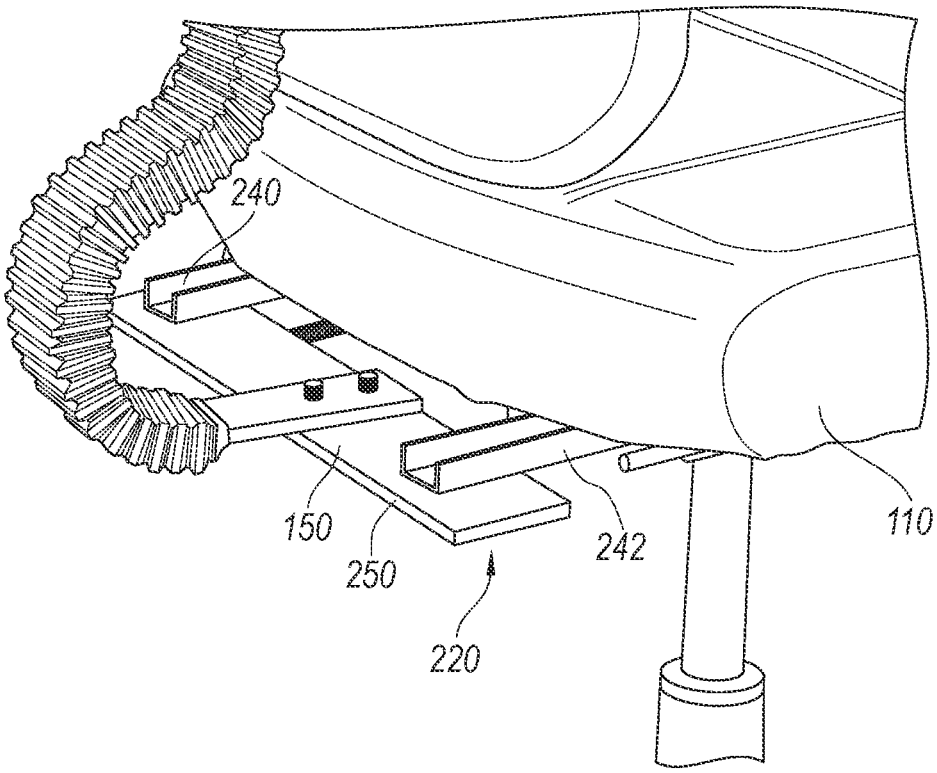
FIG. 5 is an isometric view of the adjustment mechanism of FIG. 4 in accordance with an embodiment of the technology.
Figure 6:
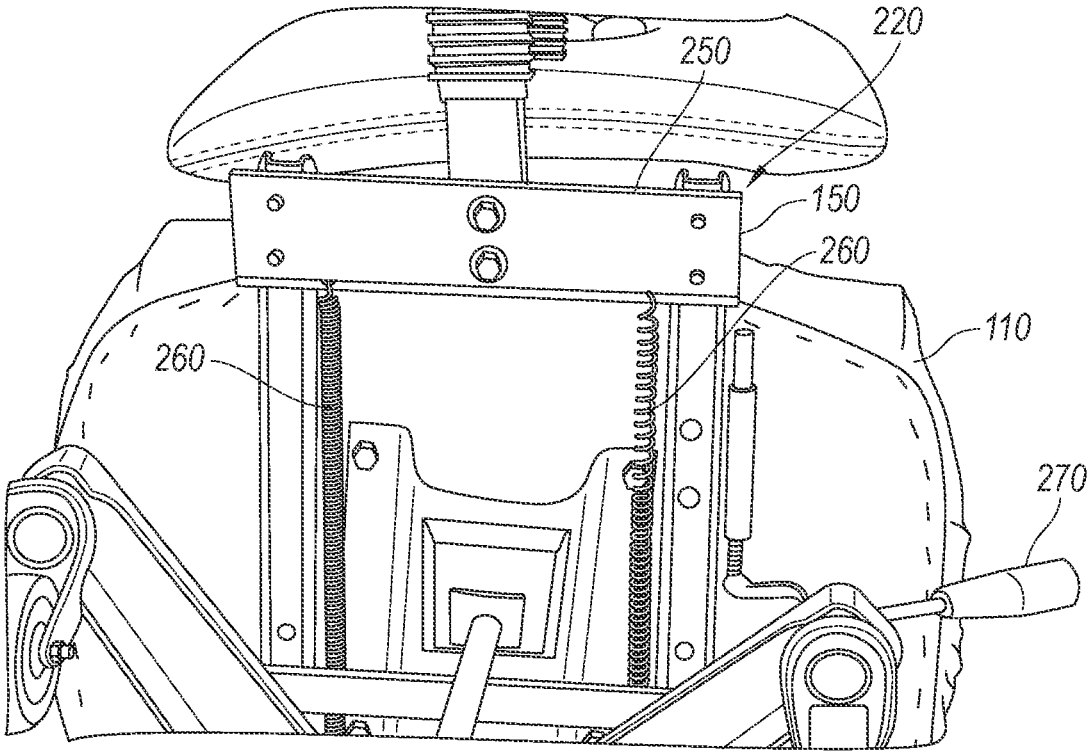
FIG. 6 is a bottom view of the adjustment mechanism configured to position the back support at a rearward position.

Referring now to FIGS. 5 and 6, the slide assemblies 220 can include a pair of linear slides 240, 242 and a bracket 250 connecting the back support 140 to the linear slides 240, 242. The linear slides 240, 242 can include one or more rails, receivers, locking mechanisms, carriages, rack, gears, rollers, or other components configured to provide linear translation. The bracket 250 can extend between the rails 240, 242. Each slide 240, 242 can include an elongated member that is slideably received by a holder fixedly coupled to the seat support assembly 110.

Referring now to FIG. 6, a plurality of biasing devices 260 (e.g. one or more springs, helical springs, etc.) can bias the bracket 250 toward the forward position. For example, the illustrated biasing devices 260 can pull the back-support 120 forwardly. When a lever 270 is actuated, the adjustment mechanism 150 can be switched from a locked state to an unlocked state, thereby letting the biasing devices 260 pull the back support assembly 120 forwardly. The components, configuration, and operation of the adjustment mechanism 150 can be selected based on the desired operation.

Figure 7:
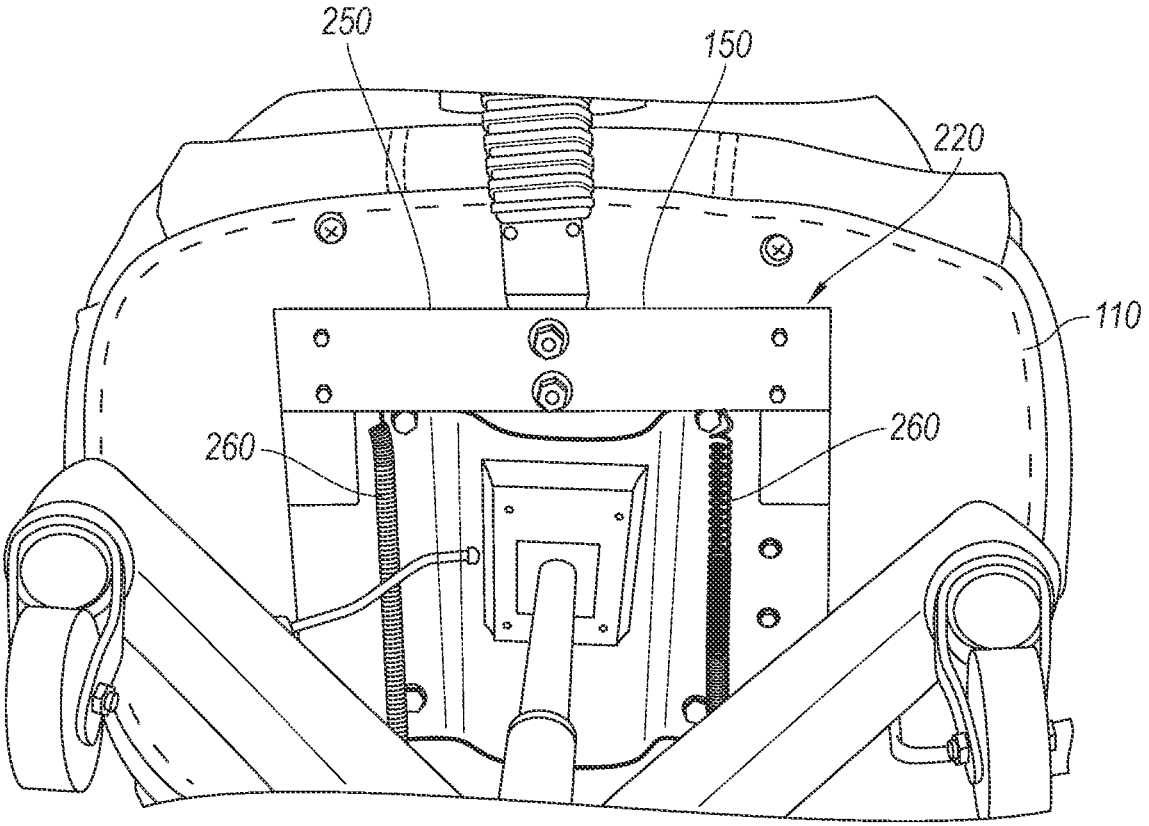
FIG. 7 is a bottom view of the adjustment mechanism configured to position the back support at a forward position.

FIG. 7 shows the adjustment mechanism 150 positioned or configured to position the back support 140 at the forward position. The adjustment mechanism 150 can include one or more levers (one identified in FIG. 8) for unlocking and locking.

Figure 8:
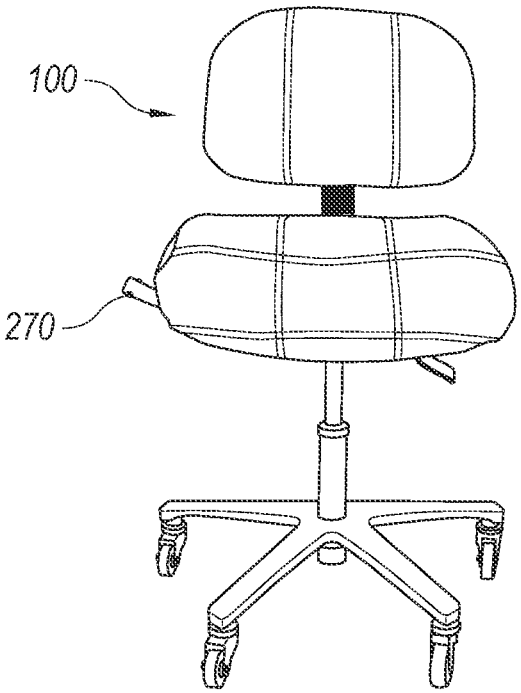
FIG. 8 is a front view of the chair in accordance with an embodiment of the present technology.

FIG. 8 is a front view of the chair 100 with the lever 270 extending outwardly from below the seat support assembly 110. The lever 270 can be at other locations.

The embodiments, features, methods and techniques described herein may be incorporated into other types of support apparatuses (e.g., stools and chairs) used in a wide range of settings. In some embodiments, the apparatuses disclosed herein can include one or more of the features, systems, devices, materials, methods and techniques described in U.S. Provisional Application No. 62/630,188 and in U.S. patent application Ser. Nos. 12/876,953; 15/248,824; 14/151,753, which are incorporated herein by reference in their entireties. For example, the chairs discussed herein can include hydraulics systems, armrests, hinges, locking mechanisms, slides, or other components disclosed in U.S. patent application Ser. Nos. 12/876,953; 15/248,824; and Ser. No. 14/151,753. In addition, the embodiments, features, systems, devices, materials, methods and techniques described herein may, in certain embodiments, be applied to or used in connection with any one or more of the embodiments, features, systems, devices, materials, methods and techniques disclosed in the above-mentioned U.S. patent application Ser. Nos. 12/876,953; 15/248,824; and Ser. No. 14/151,753.

Unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. The term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A chair, comprising:

a back support including a vertical support with a C-shaped section;

a seat support assembly including a seat support and one or more wheels for rolling along a horizontal support surface; and a back support translating mechanism connecting the vertical support to the seat support assembly, the back support translating mechanism has an unlocked state for translating the back support between a rearward position and a forward position, wherein when the chair is supported on the horizontal support surface, the back support in the rearward position is positioned rearward of the seat support, and the back support in the forward position is positioned directly above the seat support and a rearward portion of the seat support is located directly underneath a rearwardly extending upper portion of the C-shaped section, wherein the back support is able to extend a range of 0-50% of an upper surface of the seal support, and wherein the upper portion of the C-shaped section moves directly above and across a central padded region of the seat support when the back support moves from the rearward position to the forward position.

2. The chair of claim 1, wherein the back support translating mechanism has a plurality of locking positions for locking the back support along a linear path of travel.

3. The chair of claim 1, wherein the back support translating mechanism includes:

a linear slide assembly coupled to the seat support assembly, and at least one biasing device that biases the back support toward the forward position.

4. The chair of claim 3, wherein the linear slide assembly includes:

a bracket coupled to the vertical support, and a plurality of linear extenders coupled to the bracket and the seat support assembly.

5. The chair of claim 1, further comprising a control lever movable to control linear translation of the back support.

6. The chair of claim 1, wherein the back support translating mechanism has a locked configuration and an unlocked configuration, wherein back support translating mechanism in the unlocked configuration allows the back support to translate rearwardly and forwardly relative to the seat support, and wherein the back support translating mechanism in the locked configuration prevents translation of the back support relative to the seat support.

7. The chair of claim 1, wherein the back support in the forward position has a front surface positioned to support a users back, and the front surface is positioned forward of a rearward end of the seat support.

8. A chair, comprising:

a back support;

a seat support;

a manually operated slider mechanism having a locked configuration and an unlocked configuration, wherein the slider mechanism in the unlocked configuration allows the back support to translate rearwardly and forwardly relative to the seat support, and wherein the slider mechanism in the locked configuration prevents translation of the back support relative to the seat support; and a vertical support having a C-shaped region with a horizontally-extending portion positionable directly above a most rearward padded region of the seat support such that the vertical support receives and extends vertically along and horizontally across an rearward section of an upper surface of the padded region of the seat support when the back support translates at least 5 inches so as to move forwardly across the seat support from a rearward position to a forward position, thereby holding a backside of the back support spaced apart forwardly of an entire rearward edge of the upper surface of the seat support, wherein the rearward edge extends between opposite sides of the seat support.

9. The chair of claim 8, wherein the back support is held at the same height when moved from the rearward position to the forward position.

10. The chair of claim 8, wherein the slider mechanism includes a plurality of sliders coupled to the seat support and a connector coupling the back support to the slider mechanism.

11. The chair of claim 8, wherein the slider mechanism has an actuator operable to cause the slider mechanism to switch between the locked configuration and the unlocked configuration.

12. The chair of claim 8, wherein the rearward most portion of the seat support is positioned directly forward of the vertical support when the back support is in the forward position.

13. The chair of claim 1, further including a slider mechanism selectively operable to allow the back support to translate rearwardly and forwardly relative to the seat support, the slider mechanism including:

a pair of linear slides, a bracket extending between the linear slides and connected to the vertical support, the bracket is movable rearwardly past the seat support, and a pair of springs positioned between the linear slides and connected to the bracket and extending forwardly past a post connecting support arms to the seat support assembly.

14. The chair of claim 8, wherein a curvature of the C-shaped region matches a curvature of a most rearward padded region of the seat support as viewed from a side of the chair.

15. The chair of claim 1, wherein a curvature of the C-shaped section matches a curvature of a most rearward padded region of the seat support as viewed from a side of the chair.

* * * * *